US007955130B2

(12) United States Patent
Liu et al.

(10) Patent No.: US 7,955,130 B2
(45) Date of Patent: Jun. 7, 2011

(54) ELECTRICAL CONNECTOR WITH SHIELDING PLATES WITHOUT MOUNTING TAIL AND GROUNDING MEMBER

(75) Inventors: Hong-Tao Liu, Kunshan (CN); Chih-Ming Chien, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/714,560

(22) Filed: Mar. 1, 2010

(65) Prior Publication Data

US 2010/0227503 A1 Sep. 9, 2010

(30) Foreign Application Priority Data

Mar. 5, 2009 (CN) ..... 200920301102

(51) Int. Cl.
*H01R 13/648* (2006.01)

(52) U.S. Cl. ..... 439/607.09; 439/607.11

(58) Field of Classification Search ..... 439/607.09, 439/607.08, 607.11, 607.05, 607.1
See application file for complete search history.

(56) References Cited

U.S. PATENT DOCUMENTS

| | | | | |
|---|---|---|---|---|
| 6,299,483 | B1 | 10/2001 | Cohen et al. | |
| 6,435,913 | B1 * | 8/2002 | Billman | 439/607.1 |
| 6,554,647 | B1 | 4/2003 | Cohen et al. | |
| 7,494,379 | B2 * | 2/2009 | Do et al. | 439/607.05 |
| 7,785,148 | B2 * | 8/2010 | Pan | 439/607.06 |
| 2009/0170373 | A1 | 7/2009 | Pan | |
| 2010/0093209 | A1 * | 4/2010 | Liu et al. | 439/541.5 |

* cited by examiner

*Primary Examiner* — Hae Moon Hyeon
(74) *Attorney, Agent, or Firm* — Ming Chieh Chang; Wei Te Chung; Andrew C. Cheng

(57) ABSTRACT

An electrical connector includes an insulative housing, a number of signal contacts, a number of shielding plates and a grounding member touching the shielding plates so that the shielding plates are jointly connected with each other. The shielding plates are assembled to the insulative housing and disposed between the signal contacts of adjacent columns. Each shielding plate includes a tab projecting into a base of the insulative housing. No mounting tail for establishing connection between the shielding plates and a circuit board is set on any of the shielding plates. Instead, the grounding member comprises a number of mounting tails for being connected to the circuit board so as to establish electrical connection between the shielding plates and the circuit board.

20 Claims, 7 Drawing Sheets

ELECTRICAL CONNECTOR WITH SHIELDING PLATES WITHOUT MOUNTING TAIL AND GROUNDING MEMBER

CROSS-REFERENCE TO RELATED APPLICATIONS

Relevant subject matters are disclosed in U.S. patent application Ser. No. 12/317,863 filed on Dec. 29, 2008, now Pub. No. 2009/0170373 and is assigned to the same applicant and the same assignee with the instant invention.

BACKGROUND OF THE INVENTION

1. Field of the Invention

The present invention relates to an electrical connector for transmitting high speed signals, and more particularly to an electrical connector having detachable shielding plates and a grounding member providing reliable and robust grounding effect.

2. Description of Related Art

U.S. Pat. No. 6,554,647 issued to Cohen on Apr. 29, 2003 discloses a high speed header connector including a U-shaped insulative housing, a plurality of signal contacts received in the insulative housing and a plurality of shielding plates disposed in parallel within the insulative housing between signal contacts in adjacent columns. Each shielding plate includes a plurality of mounting tails integrally extending therefrom for being mounted to a circuit board. However, the shielding plates are separated from each other. That is to say, each shielding plate acts as an independent grounding bus. Under this arrangement, such separate grounding buses may not provide robust shielding function in high speed signal transmission area.

Hence, an improved electrical connector is needed to solve the above problems.

BRIEF SUMMARY OF THE INVENTION

An electrical connector for being mounted on a circuit board includes an insulative housing, a plurality of signal contacts, a plurality of shielding plates and a grounding member touching the shielding plates. The insulative housing includes a base and first and second side walls extending from the base with a receiving opening disposed between the first and the second side walls. The signal contacts include contacting sections protruding beyond the base and further extending into the receiving opening. The contacting sections are arranged in parallel columns along a longitudinal direction of the insulative housing. The shielding plates are assembled to the insulative housing and disposed between the signal contacts of adjacent columns. Each shielding plate includes a tab extending into the base of the insulative housing when assembled therein. The grounding member touches the shielding plates so that the shielding plates are jointly connected with each other. No mounting tail for establishing connection between the shielding plates and the circuit board is set on any of the shielding plates. Instead, the grounding member comprises a plurality of mounting tails for being connected to the circuit board so as to establish electrical connection between the shielding plates and the circuit board.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
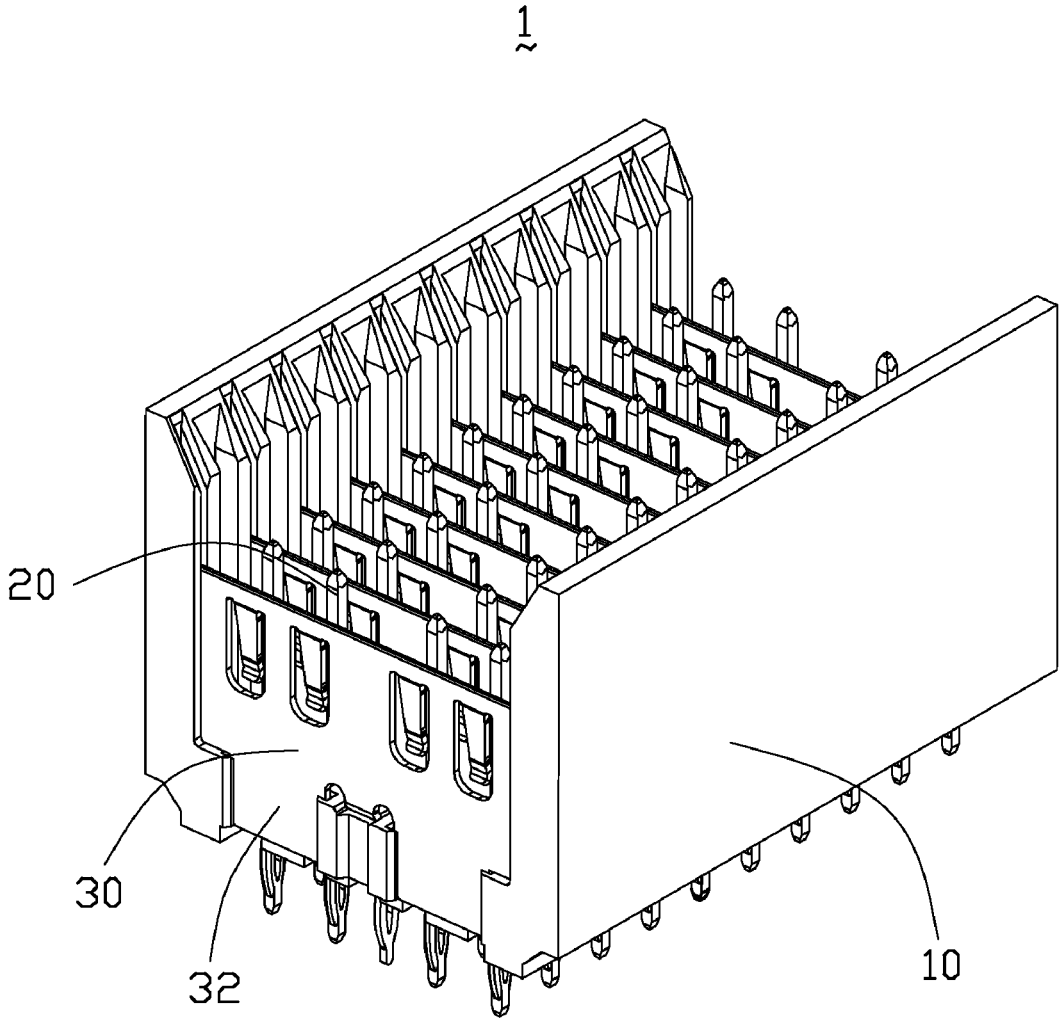
FIG. 1 is a perspective view of an electrical connector in accordance with an embodiment of the present invention.
Figure 2:
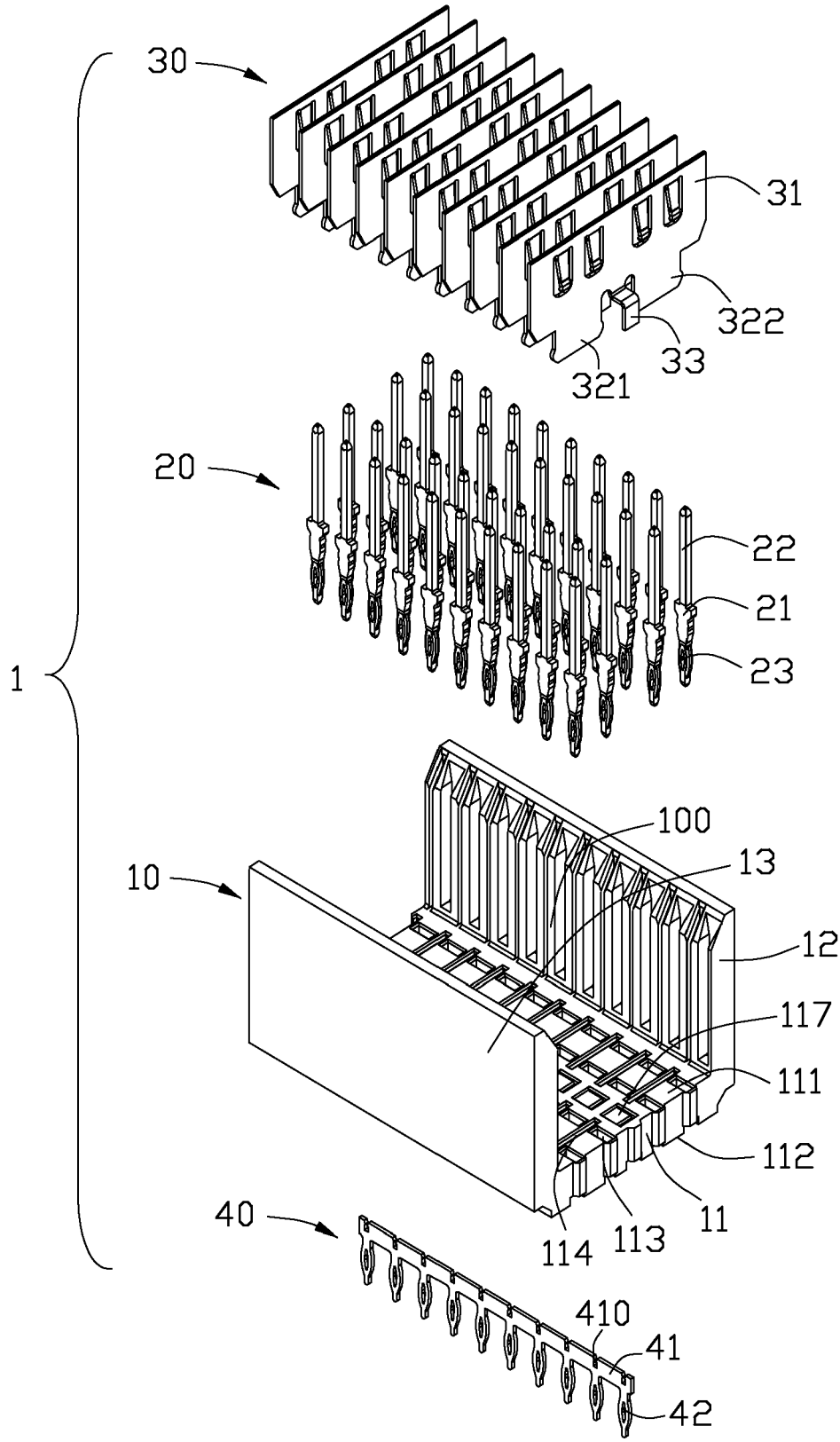
FIG. 2 is an exploded view of the electrical connector as shown in FIG. 1.
Figure 7:
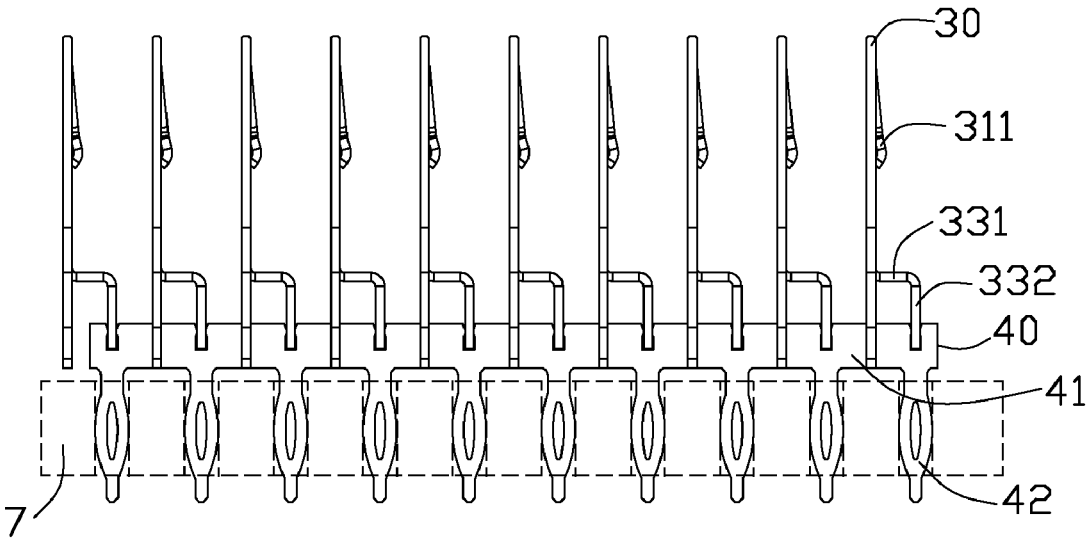
FIG. 7 is a side view of the shielding plates abutting against the grounding member as shown in FIG. 6.

Reference will now be made to the drawing figures to describe the preferred embodiment of the present invention in detail. FIGS. 1, 2 and 7 illustrate a high speed electrical connector 1 mounted on a circuit board 7 for mating with a daughter card connector (not shown) received therein. The electrical connector 1 includes an insulative housing 10, a plurality of signal contacts 20 secured in the insulative housing 10 in parallel columns, a plurality of shielding plates 30 located between the signal contacts 20 arranged in adjacent columns, and a grounding member 40 jointly connecting the shielding plates 30.

Figure 3:
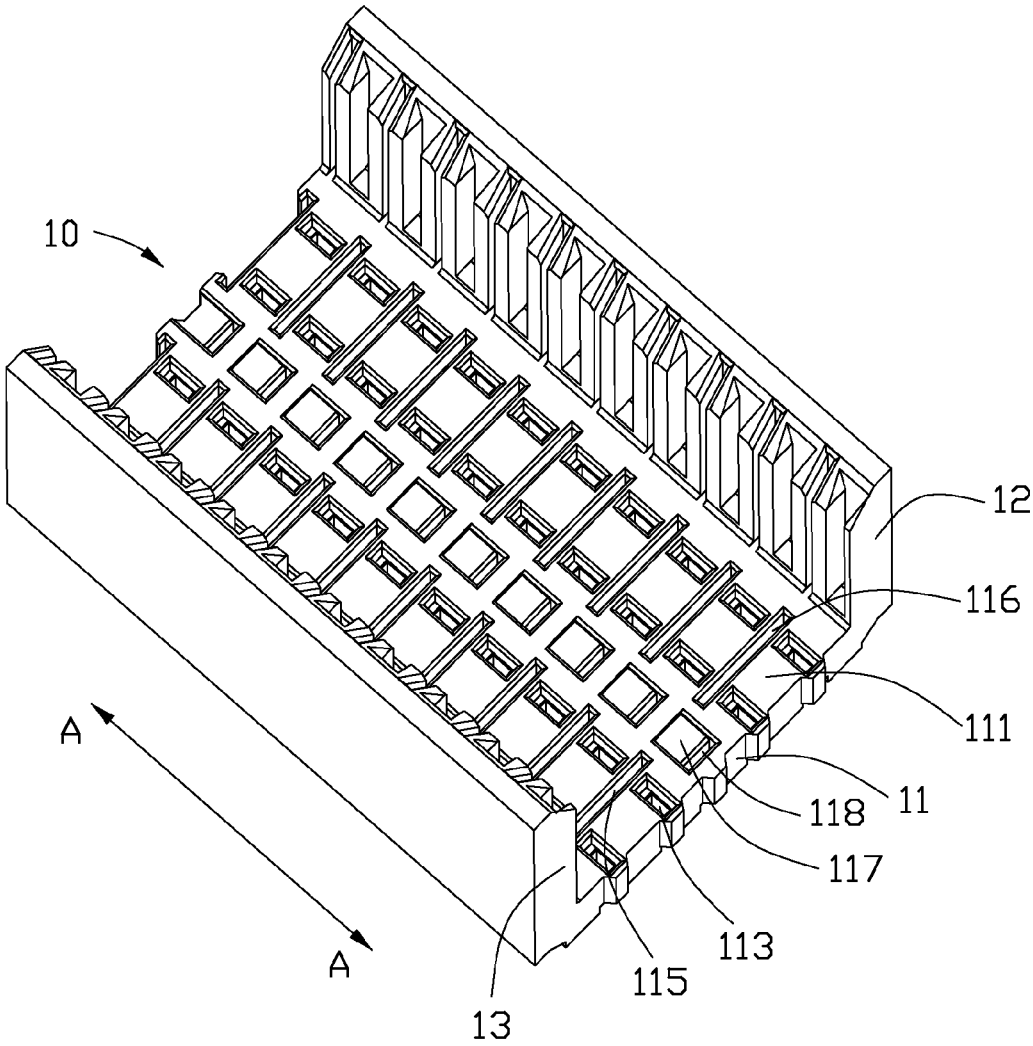
FIG. 3 is a perspective view of an insulative housing as shown in FIG. 1.
Figure 4:
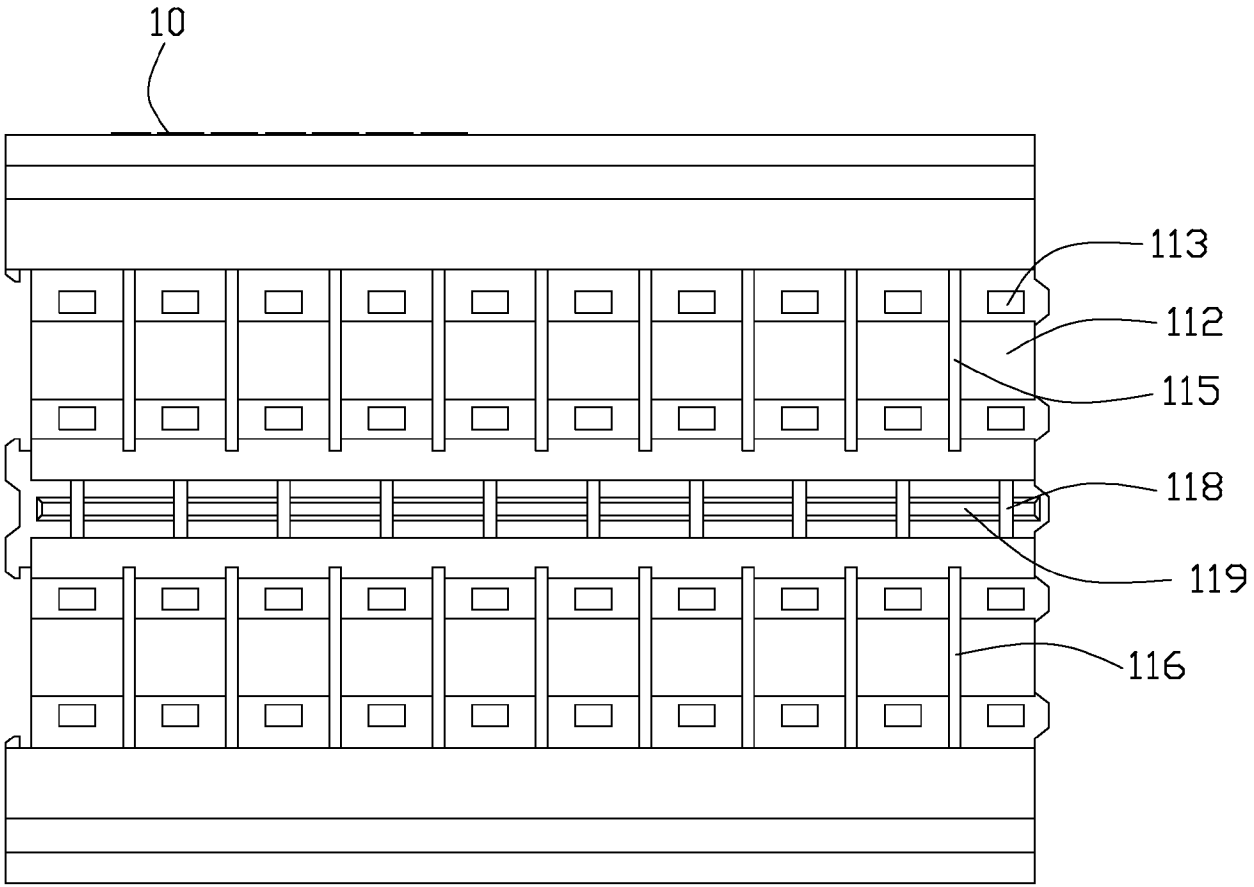
FIG. 4 is a bottom view of the insulative housing as shown in FIG. 3.
Figure 5:
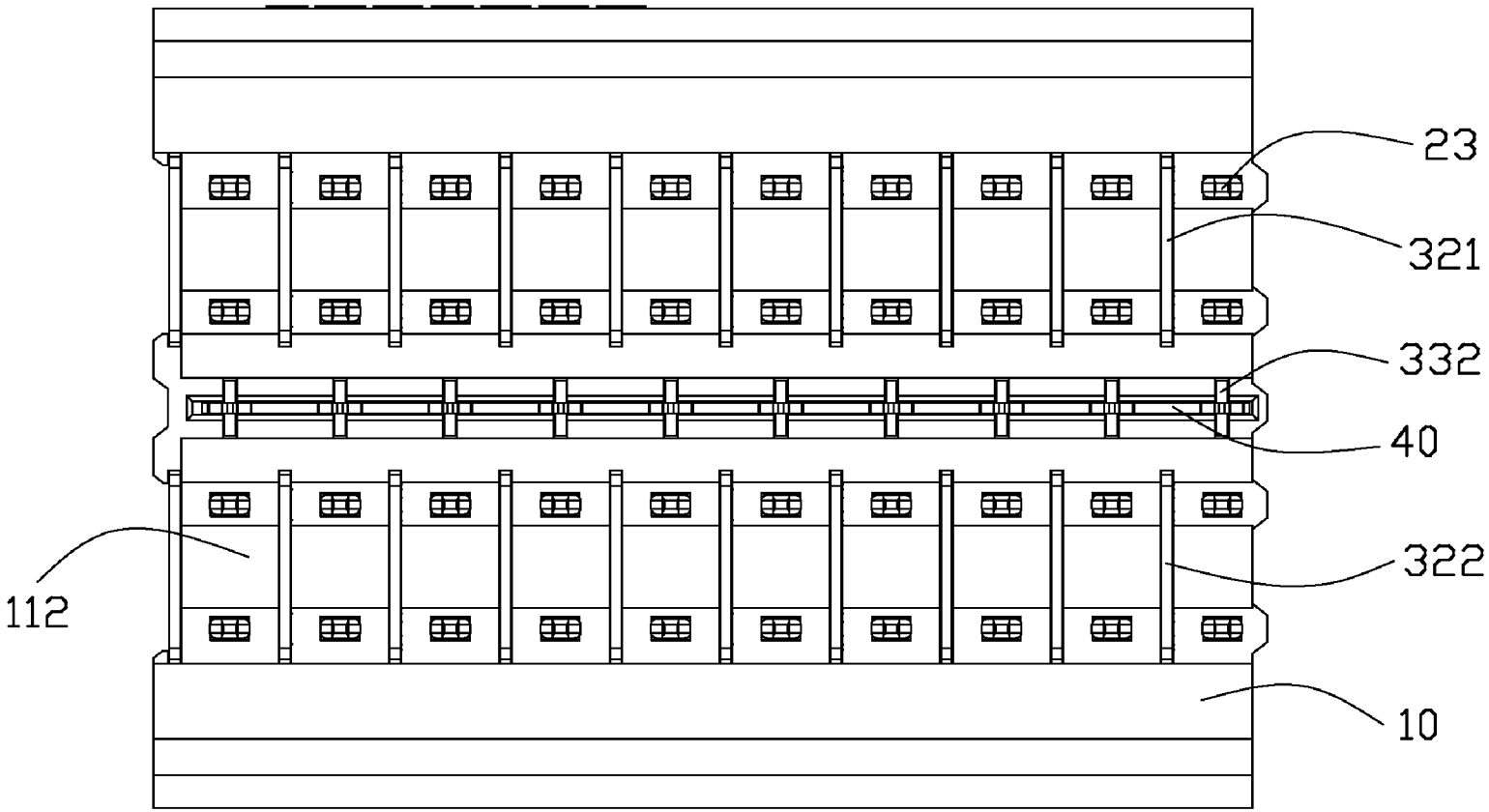
FIG. 5 is a bottom view of the insulative housing with a plurality of signal contacts, shielding plates and a grounding member fixed thereto.
Figure 6:
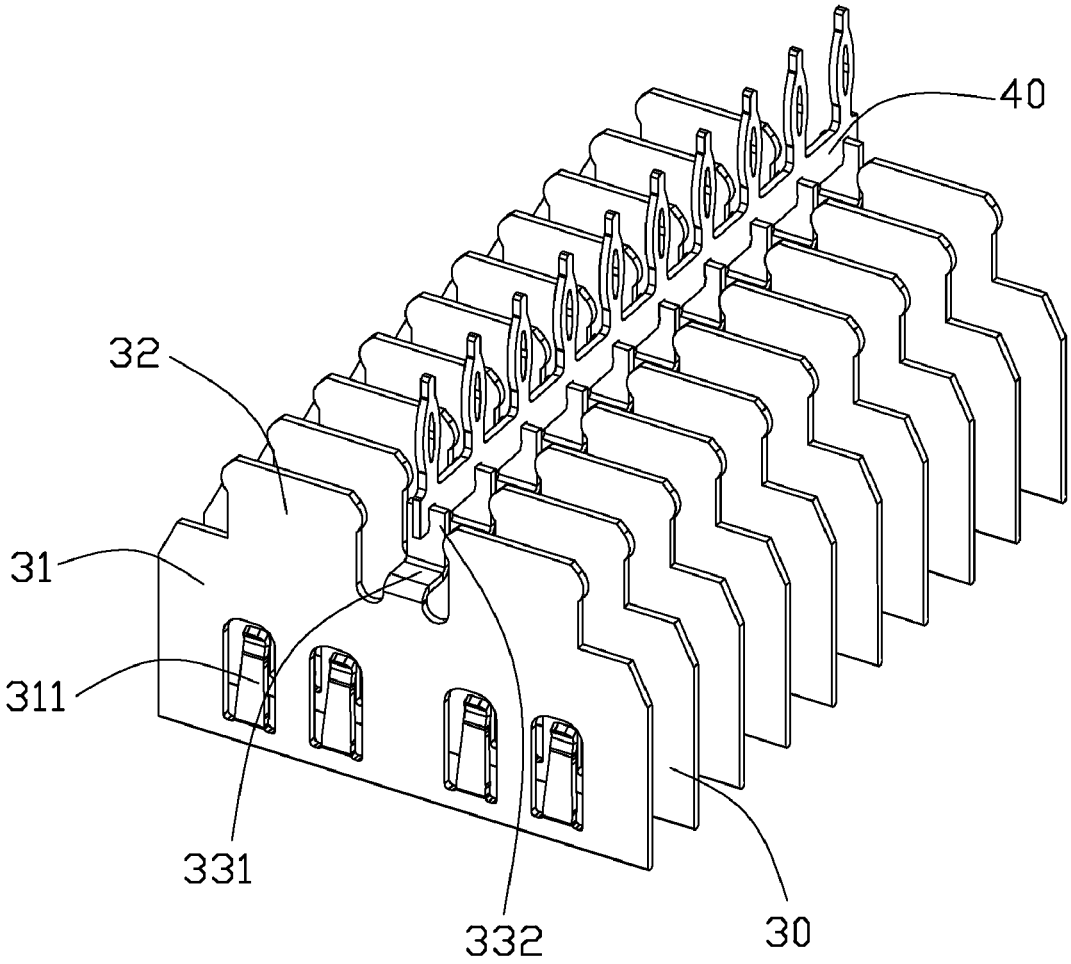
FIG. 6 is a perspective view of the shielding plates abutting against the grounding member.

Referring to FIGS. 2-5, the insulative housing 10 has a U-shaped configuration and includes a base 11 and a pair of first and second side walls 12, 13 extending upwardly from lateral sides of the base 11. The first and the second side walls 12, 13 define jointly with the base 11 a receiving opening 100 for receiving the daughter card connector. The base 11 includes a top surface 111 exposed to the receiving opening 100 and a bottom surface 112 for being mounted on the circuit board. A plurality of passageways 113 are defined through the top and the bottom surfaces 111, 112 of the base 11 for mounting the signal contacts 20. The passageways 113 are arranged along a longitudinal direction A-A of the insulative housing 10 as shown in FIG. 3. Besides, a plurality of slits 114 are defined and extend from the top surface 111 to the bottom surface 112 of the base 11 for mounting the shielding plates 30. Each slit 114 extends along a transverse direction perpendicular to the longitudinal direction A-A. Each slit 114 includes a first slit 115 and a second slit 116 separated from the first slit 115 along the transverse direction. The base 11 further defines a plurality of depressions 117 recessed from the top surface 111 and a plurality of through holes 118 communicating with the corresponding depressions 117. The depressions 117 and the through holes 118 are disposed between the first and the second slits 115, 116. A longitudinal slot 119 is defined through the bottom surface 112 of the base 11 and is in communication with the through holes 118 for receiving the grounding member 40.

Referring to FIG. 2, the signal contacts 20 are configured into several differential pairs for transmitting high speed signals. Each signal contact 20 is configured in pin shaped and includes a fastening portion 21 fixed in the passageways 113 of the insulative housing 10, a contacting section 22 protruding upwardly into the receiving opening 100 and a press-fit portion 23 downwardly extending beyond the bottom surface 112 of the insulative housing 10. The press-fit portions 23 are inserted into holes defined in the circuit board 7.

Referring to FIGS. 3-7, the shielding plates 30 are assembled to the insulative housing 10 and are disposed between the signal contacts 20 in adjacent columns. Each shielding plate 30 includes a shielding body 31 residing in the receiving opening 100 of the insulative housing 10, a retaining portion 32 extending from the shielding body 31 and a tab 33 extending from the shielding body 31 as well. The shielding body 31 extends upwardly a predetermined distance for shielding the contacting sections 22 in adjacent columns. The shielding body 31 includes a plurality of finger springs 311 sidewardly protruding into the receiving opening 100 for abutting against the daughter card connector. The retaining portion 32 includes a first part 321 and a second part 322 separated from the first part 321 with the tab 33 disposed between the first and the second parts 321, 322. The first and the second parts 321, 322 are fixed in the corresponding first and the second slits 115, 116, respectively. The tab 33 is L-shaped and includes a sideward bending section 331 and an extension 332 bent downwardly from the bending section 331. The bending section 331 is perpendicular to the shielding body 31 and is located at a horizontal plane. The extension 332 is in parallel to the shielding body 31 along a vertical direction. However, the extension 332 and the shielding body 31 are located at different planes.

The grounding member 40 includes a longitudinal fixation 41 received in the slot 119 of the insulative housing 10, and a plurality of mounting tails 42 integrally extending downwardly from the fixation 41. The fixation 41 defines a plurality of notches 410 for receiving the extensions 332 of the shielding plates 30 so that the shielding plates 30 can be firmly abutting against the grounding member 40. The mounting tails 42 protrude beyond the bottom surface 112 of the base 11 for being mounted on the circuit board 7. Each mounting tail 42 is aligned with the corresponding press-fit portions 23 of the signal contacts 20 in a nearby column along the transverse direction.

In assembly, the shielding plates 30 and the grounding member 40 are vertically fixed to the base 11 along opposite directions. The bending sections 331 and the extension 332 are received in the depressions 117 and the through holes 118, respectively. The extension 332 projects into the base 11. The fixation 41 mechanically touches the extension 332 between the top and the bottom surfaces 111, 112 of the base 11.

According to the present invention, no mounting tail is set on the shielding plates 30 so that the structures of the shielding plates 30 can be simplified and assemblies of the shielding plates 30 to the base 11 can be facilitated accordingly. Besides, all the shielding plates 30 are connected by the grounding member 40 with the plurality of the mounting tails 42 as a result that connection between the shielding plates 30 and the circuit board 7 is stably established.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector for being mounted on a circuit board, comprising:

an insulative housing comprising a base and first and second side walls extending from the base with a receiving opening disposed between the first and the second side walls;

a plurality of signal contacts with contacting sections protruding beyond the base and further extending into the receiving opening, the contacting sections being arranged in parallel columns along a longitudinal direction of the insulative housing;

a plurality of shielding plates assembled to the insulative housing, each comprising a shielding body disposed between the signal contacts of adjacent columns and a tab sidewardly bent from the shielding body, the tab comprising an extension parallel to the shielding body and projecting into the base of the insulative housing, the extension and the shielding body being located at different planes; and a grounding member touching the shielding plates so that the shielding plates are jointly connected with each other; wherein no mounting tail for establishing connection between the shielding plates and the circuit board is set on any of the shielding plates; instead, the grounding member comprises a plurality of mounting tails for being connected to the circuit board so as to establish electrical connection between the shielding plates and the circuit board.

2. The electrical connector as claimed in claim 1, wherein the base comprises a top surface exposed to the receiving opening and a bottom surface for being mounted to the circuit board, the shielding plates being attached to the base through the top surface along a first direction, and the grounding member being attached to the base through the bottom surface along a second direction opposite to the first direction.

3. The electrical connector as claimed in claim 2, wherein the base defines a slot recessed from the bottom surface and extending along the longitudinal direction, the grounding member comprising a fixation received in the slot, the mounting tails integrally extending from the fixation and further protruding beyond the bottom surface of the base.

4. The electrical connector as claimed in claim 3, wherein the fixation defines a plurality of notches to receive the extensions.

5. The electrical connector as claimed in claim 4, wherein each extension mechanically meets the fixation in the base between the top and the bottom surfaces.

6. The electrical connector as claimed in claim 3, wherein each shielding body resides in the receiving opening and is disposed between the signal contacts of adjacent columns, each shielding plate comprises a retaining portion extending from the shielding body, and the base defines a plurality of slits recessed from the top surface to fix the retaining portions.

7. The electrical connector as claimed in claim 6, wherein each retaining portion comprises a first part and a second part separated from the first part with the tab disposed between the first and the second parts.

8. The electrical connector as claimed in claim 3, wherein the tab comprises a sideward bending section from which the extension is bent, the bending section being located at a horizontal plane.

9. The electrical connector as claimed in claim 8, wherein the tab is L-shaped, the extension and the shielding body being located at different vertical planes.

10. The electrical connector as claimed in claim 8, wherein the base defines a depression recessed from the top surface to receive the bending section, and a through hole communicating with the depression to receive the extension, the through hole being in communication with the slot.

11. An electrical connector comprising:

an insulative housing including a base, first and second side walls, and a receiving opening jointly formed by the base and the first and the second side walls;

a plurality of signal contacts with contacting sections protruding into the receiving opening, the contacting sections being arranged in parallel columns;

a plurality of shielding plates each including a retaining portion vertically fixed to the base, a shielding body disposed between the signal contacts of adjacent columns, and a tab sidewardly bent from the shielding body, the tab comprising an extension parallel to the shielding body and projecting into the base of the insulative housing; and a grounding member vertically fixed to the base and defining a plurality of notches to receive the extensions so that the shielding plates are jointly connected with each other via the grounding member; wherein the shielding plates and the grounding member are fixed to the base from opposite directions; and wherein the grounding member comprises a plurality of mounting tails for being connected to a circuit board so as to establish electrical connection between the shielding plates and the circuit board.

12. The electrical connector as claimed in claim 11, wherein the base comprises a top surface exposed to the receiving opening and a bottom surface for being mounted to the circuit board, the base defining a slot recessed from the bottom surface along a longitudinal direction perpendicular to the shielding body, the grounding member comprising a fixation received in the slot, the mounting tails integrally extending from the fixation and further protruding beyond the bottom surface of the base.

13. The electrical connector as claimed in claim 12, wherein the plurality of notches are defined in the fixation.

14. The electrical connector as claimed in claim 13, wherein the extension mechanically meets the fixation in the base between the top and the bottom surfaces.

15. The electrical connector as claimed in claim 11, wherein each tab is L-shaped and comprises a horizontal sideward bending section from which the extension is bent, and the extension is parallel to the shielding body and located at different vertical planes.

16. The electrical connector as claimed in claim 15, wherein each retaining portion comprises a first part and a second part separated from the first part with the tab disposed between the first and the second parts.

17. An electrical connector for mounting to a printed circuit board, comprising:

an insulative housing;

a plurality of contacts disposed in the housing in matrix with rows and columns perpendicular to each other, each of said contacts defining a mounting tails extending downwardly beyond a bottom face of the housing for mounting to said printed circuit board;

a plurality of shielding plates assembled to the housing to separate said contact in a row direction; and at least one grounding member extending along a column direction perpendicular to said row direction and intersecting with said shielding plates in an perpendicular and interengagement manner; wherein a plurality of mounting tails unitarily extend downwardly from the grounding member for mounting to the printed circuit board while the shielding plates are equipped with none of said mounting tails; and wherein each of said shielding plates defines a tab offset from a primary plane defined by said shielding plate, and the grounding member engages said tab.

18. The electrical connector as claimed in claim 17, wherein the tab is parallel to the primary plane.

19. The electrical connector as claimed in claim 18, wherein at least one of said tab and said grounding member defines a notch to receive the other for interengagement therebetween.

20. The electrical connector as claimed in claim 19, wherein said notch is formed in said grounding member.

* * * * *